United States Patent [19]

Klukos

[11] 4,453,341

[45] Jun. 12, 1984

[54] HOOP CONTROL GUIDE

[76] Inventor: Edward Klukos, 10030 - 152nd St., West Olive, Mich. 49460

[21] Appl. No.: 422,573

[22] Filed: Sep. 24, 1982

[51] Int. Cl.[3] ..... A63H 33/02

[52] U.S. Cl. ..... 446/450

[58] Field of Search ..... 46/220, 114

[56] References Cited

U.S. PATENT DOCUMENTS

| | | | |
|---|---|---|---|
| 2,251,599 | 8/1941 | Peterson | 46/220 |
| 2,577,189 | 12/1951 | Hammett | 46/220 |
| 2,791,064 | 5/1957 | McDonald | 46/220 |
| 3,242,612 | 3/1966 | Sakwa | 46/220 |
| 3,531,889 | 10/1970 | Poole | 46/220 |
| 3,604,149 | 9/1971 | Salontai | 46/220 |
| 4,333,260 | 6/1982 | Hawkins, Sr. | 46/220 |

*Primary Examiner*—Gene Mancene
*Assistant Examiner*—David I. Tarnoff
*Attorney, Agent, or Firm*—Price, Heneveld, Huizenga & Cooper

[57] ABSTRACT

A hoop control guide includes a lower hoop engaging V-shaped member having legs converging at a first angle and a second integral and upwardly inclined V-shaped member integral with the lower V-shaped member and having a substantially smaller converging angle of the legs. In the preferred embodiment of the invention, the end of the hoop control guide incorporating the two angularly related V-shaped hoop engaging members is integrally formed from bent wire and attached to a suitable hand-held shaft.

14 Claims, 4 Drawing Figures

HOOP CONTROL GUIDE

BACKGROUND OF THE INVENTION

The present invention pertains to a jogging aid and particularly a hoop control guide.

There exists a variety of hoop rolling controls to assist in the propulsion of a hoop along the ground. U.S. Pat. Nos. 3,242,612; 3,604,149; 2,791,064 and DES 261,910, are representative of such prior art devices.

None of the prior art devices, however, efficiently accommodate for high and low speed maneuvering or provide the relative ease of starting as does the improved control guide of the present invention.

SUMMARY OF THE PRESENT INVENTION

The control guide of the present invention provides an improved hoop propulsion device in which a guide comprises a combination of a lower hoop engaging V-shaped member having legs converging at a first angle and a second integral and upwardly inclined V-shaped member integral with the first V-shaped member and having legs converging at a substantially smaller angle. In the preferred embodiment of the invention, the end of the hoop control guide incorporating the two V-shaped hoop engaging members is integrally formed from bent wire and attached to a suitable hand-held shaft.

By providing two angularly related V-shaped hoop engaging members, improved control of a hoop is achieved. Thus, for starting the hoop, the deeper cut upper V-shaped member is employed to initially cradle the hoop at rest and begin the rolling action while once under way, the lower V-shaped member is employed for increased speed without excess lateral movement. For lower speed operation and maneuverability, again the upper V-shaped member is employed. These and other objects, features and advantages of the present invention can best be understood by referring to the following description thereof together with reference to the accompanying drawings in which:

DETAILED DESCRIPTION OF THE PREFERRED EMBODIMENT

Figure 1:
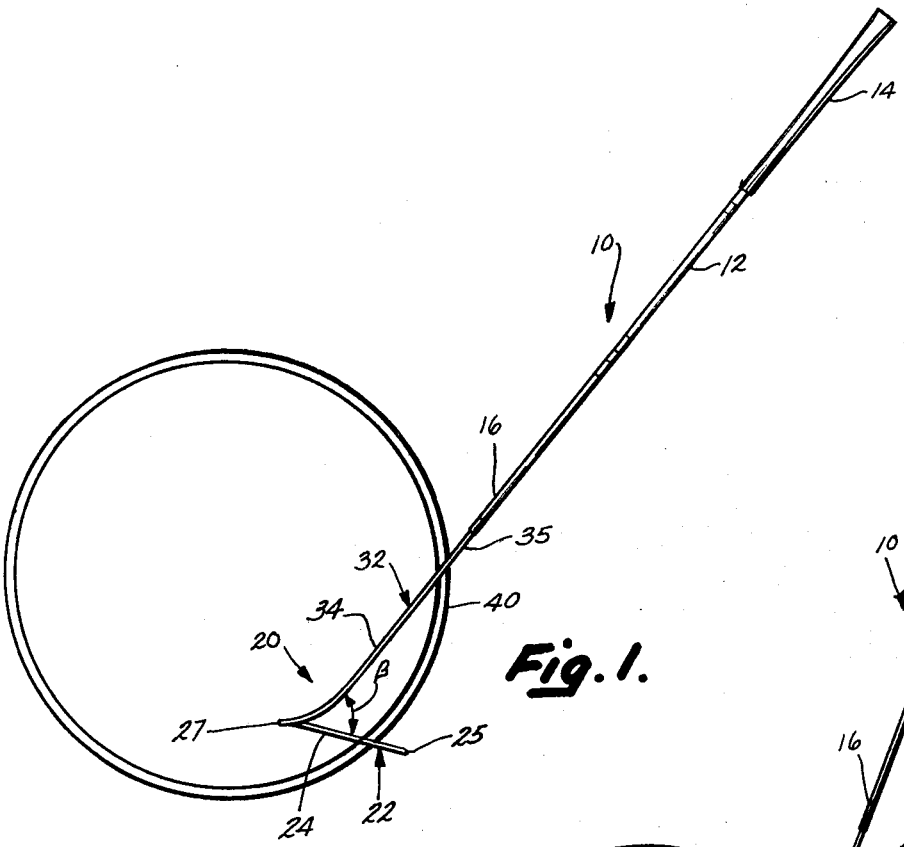
FIG. 1 is a side elevational view of the hoop guide and control apparatus shown in a first position with respect to a hoop.
Figure 2:
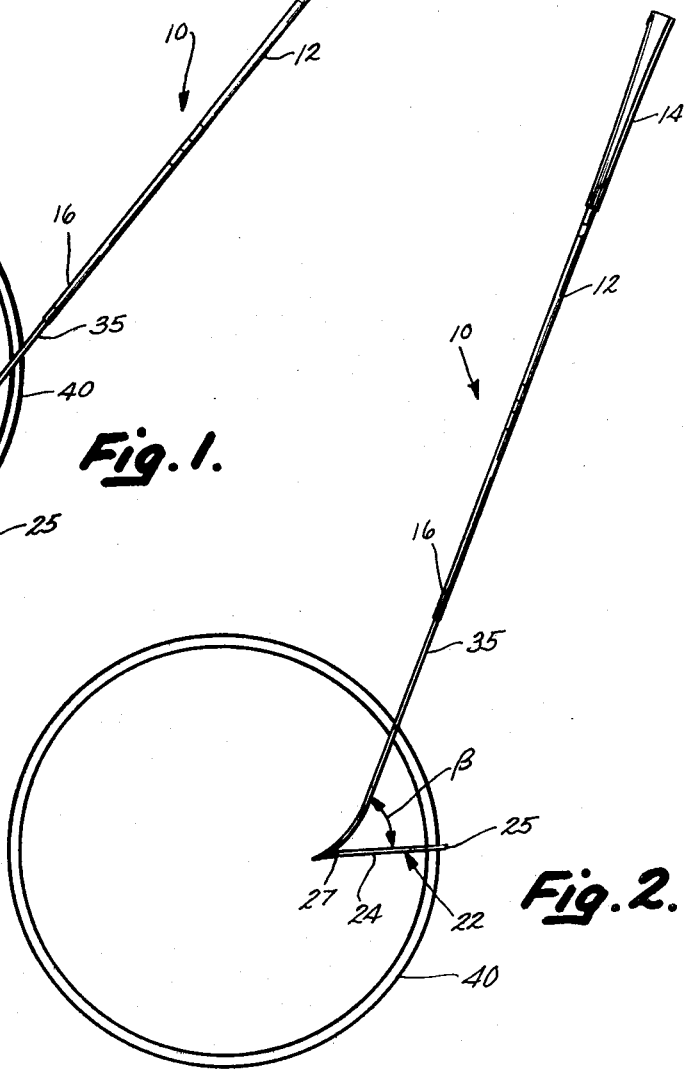
FIG. 2 is a side elevational view of the structure shown in FIG. 1 shown in a second hoop controlling position.
Figure 4:
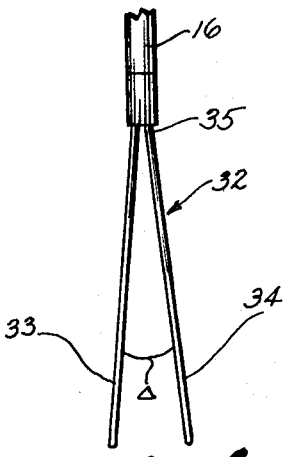
FIG. 4 is a fragmentary top plan view of the upper V-shaped member of the hoop guide and control.

Referring now to the Figures, the hoop guide and control of the present invention comprises, as best seen in FIGS. 1 and 2, handle means 10 to which there is coupled a hoop guide and control member 20 for guiding and controlling therein a hoop 40. The handle means 10 comprises a tapered, light-weight, hollow shaft 12 similar to that employed in a golf club and having a hand grip 14 at one end and a hollow, open opposite end 16 for receiving the free ends of the wire formed guide and control means as shown in FIG. 4. End 16, can, if desired, be crimped to permanently secure the free ends of the wire-formed guide and control means 20 therein or the ends of the wire can be sufficiently long so that they can simply be force fitted into the tapered, open end 16 of handle means 10. The unique guide and control means 20 for controlling a hoop for slow or high speed maneuverability and for stopping and lifting the hoop from the ground is now described.

Figure 3:
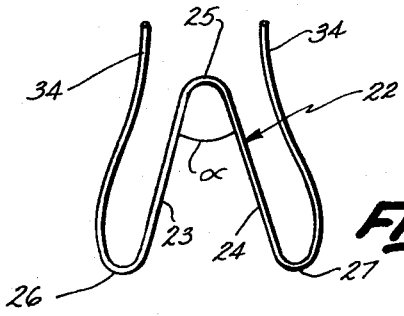
FIG. 3 is a fragmentary top plan view of the lower V-shaped member of the hoop guide and control shown in FIGS. 1 and 2.

Member 20 is integrally formed of a wire having a diameter of from about $\frac{1}{8}$ to $\frac{1}{4}$ of an inch with 3/16 of an inch being employed in the preferred embodiment. The wire can be galvanized or chrome plated steel or of aluminum. If aluminum, however, $\frac{1}{4}$ inch has been found to be the most desirable size. The wire has a smooth surface and is configurated by bending first to define a lower V-shaped member 22 defined by inwardly converging legs 23 and 24 which, as best seen in FIG. 3, converge to an apex 25 at an angle $\alpha$ which can be from about 30° to 50° and, in the preferred embodiment, was approximately 40°. The length of legs 23 and 24 are from about 3 to 5 inches such that, as best seen in FIG. 2, the lower V-shaped member 22 has sufficient depth to cradle an average diameter hoop 40. Hoop 40 comprises a circle having a diameter of approximately 18 to 24 inches or larger and a cross-sectional diameter of from about 3/16 to $\frac{1}{2}$ inch. The hoop can be made of any suitable material such as rust resistant wire for smaller cross-sectionsl hoops to hollow plastic for larger hoops.

The ends of legs 23 and 24 remote from apex 25 defining the lower or first V-shaped member 22 are then curved upwardly, outwardly and rearwardly at curved bends 26 and 27 as best seen in FIGS. 1, 2 and 3. The upward inclination of the wire forming the control and guide means from the ends of the lower V-shaped member 22 is shown in FIGS. 1 and 2 as angle $\beta$ and in the preferred embodiment, was approximately between 40° and 60°. The wire forming the control and guide means thus integrally defines a second or upper V-shaped member 32 with a pair of inwardly converging legs 33 and 34. As best seen in FIG. 4, the ends of legs 33 and 34 are integral with and joined to the ends 26 and 27 of lower V-shaped member 22 and the opposite ends of legs 33 and 34 define an apex 35 at the junction of these legs with handle 10. The free ends of legs 33 and 34 extend into the hollow end of tube 12 at end 16 a distance sufficient to securely hold the wire formed guide and control means to the handle means. If desired, the free ends 33 and 34 of the upper V-shaped member 32 can be either crimped within the handle means or bonded therein by a suitable bonding adhesive. Replacement wire guide and control means can simply be slipped into the end of handle after first removing the original wire form. The legs 33 and 34 of the second or upper V-shaped member 32 converge at an angle $\Delta$ which is substantially smaller than angle $\alpha$ and, in the preferred embodiment, ranged from about 15° to 30°. The length of legs 33 and 34 from tips 26 and 27 to apex 35 ranged from about 8 to 16 inches with 12 inches in the preferred embodiment of the invention. The corner radius of each of the bends 25, 26 and 27 was approximately $\frac{3}{4}$ to 1 inch to provide a smooth transition in the direction of the wire form.

The provision of a pair of first and second V-shaped members formed at an angle to each other and having forwardly facing openings defined by legs converging at substantially different angles provides two distinct control effects for a hoop 40 used in association with the guide and control means. Referring initially to FIG. 1 which illustrates the starting or low speed position of a hoop, it is seen that the hoop 40 rests between the legs 33 and 34 of upper V-shaped member 32 with the hoop engaging the sides of apex 35. For starting and slow speeds, the hoop may contact both upper and lower V-shaped members simultaneously to establish a vertical or near vertical starting plane for the hoop. The narrow converging angle of legs 33 and 34 cradle the hoop snugly and thereby can hold the hoop in a generally vertical plane to facilitate starting the hoop from a stationary position. Also, the narrowly converging upper legs 33 and 34 of V-shaped member 32 provide tight control of the hoop when rolling along the ground or other horizontal surface at relatively low speeds.

The lower V-shaped member 22 is employed for propelling the hoop and for higher speed use and maneuverability. As illustrated in FIG. 2, the angle of handle means 10 to the ground can be increased somewhat so the hoop can be brought rearwardly closer to the body of the user with the V-shaped member 22 extending substantially horizontally to the ground and apex 25 engaging the outer periphery of the hoop. In this position, the apex 25 is located at approximately half way between the center of the circular hoop and ground for maximum speed and control by the legs 23 and 24 of the lower V-shaped member. At higher speeds, the lower, wider V-shaped member 22 provides the desired lateral control while permitting a relatively high forward velocity of the hoop 40.

In order to stop the hoop once rolling, the hoop is allowed to disengage from the guide and control and handle means 10 rotated approximately 90° such that the hoop can be snagged within the V-shaped junction of V-shaped members 22 and 32 with the hoop engaging the upper and lower V-shaped members simultaneously and cradled in the apex of the V-shaped member defined by angle $\beta$ in the side elevational views of FIGS. 1 and 2. This will permit the user to stop and rest if jogging or reposition the hoop for a new maneuver. Also, the hoop can be stored in conjunction with the guide and control by hanging from the junction of the upper and lower V-shaped members with the handle grip 14 of the handle means secured to a suitable wall-mounted clip.

The upper V-shaped member assists in maintaining a vertical plane of the hoop at starting or slow speeds when the hoop has not yet started to gyro due to low inertia at slow speed. This can be a snug or loose guide on hoop sides, as needed, by the operator positioning the guide higher or lower on the hoop. The lower V-shaped member is primarily used to push or propel the hoop but may disengage entirely when the hoop has attained suitable jogging speed or begins to gyro (therefore, needing less vertical guide). The lower and wider V-shaped member facilitates ease of recontacting the hoop to maintain jogging speed as it slows down. Hoop side guiding and turning by the lower V-shaped member can be accomplished at high speed as is done by the upper V-shaped member at low speed allowing proper control throughout the full range of speed. The operator develops this technique through practice and experience.

It will become apparent to those skilled in the art that various modifications to the preferred embodiment of the invention as described herein can be made without departing from the spirit or scope of the invention as defined by the appended claims.

The embodiments of the invention in which an exclusive property or privilege is claimed are defined as follows:

1. A hoop guide and control comprising:

elongated handle means extending along an axis and including a control and guide member coupled thereto, wherein said control and guide means includes a first forwardly opening V-shaped member formed by a first pair of legs converging to an apex at a first angle, said first pair of legs coupled to said handle means and lying in a plane at a predetermined acute angle with respect to said axis of said handle means with said apex aligned with said axis, and a second forwardly opening V-shaped member coupled to said handle means and positioned between said first V-shaped member and said handle means and formed by a second pair of legs converging to an apex at a second angle less than said first angle, said second pair of legs lying in a plane generally aligned with said axis of said handle means and with said apex of said second pair of legs aligned with said axis, whereby said control and guide member can receive a hoop in at least one of said V-shaped members to effectively start, stop and control the hoop at different speeds.

2. The apparatus as defined in claim 1 wherein said first and second V-shaped members are integrally formed of a wire material the free ends of which meet at said apex of said second V-shaped member.

3. The apparatus as defined in claim 2 wherein the first and second V-shaped members are integrally joined at ends remote from the apecies of the converging legs.

4. The apparatus as defined in claim 3 wherein the first and second V-shaped members intersect at an angle of from about 40° to 60°.

5. The apparatus as defined in claim 4 wherein said legs of said first V-shaped member converge at an angle of from about 30° to 50°.

6. The apparatus as defined in claim 5 wherein said legs of second V-shaped member converge at an angle of from about 15° to 30°.

7. The apparatus as defined in claim 6 wherein said control and guide member is integrally bent of wire having a diameter of from about $\frac{1}{8}$ to $\frac{1}{4}$ inches.

8. The apparatus as defined in claim 7 wherein said handle means comprises a hollow shaft for receiving ends of said wire remote from said lower V-shaped member for securing said control and guide member to said shaft.

9. An exercise device comprising:

a circular hoop; and a hoop guide and control for controllably guiding the hoop along a surface, wherein said hoop guide and control includes an elongated shaft with a hand grip at one end and a wire-formed guide coupled to the opposite end, said guide comprising first and second forwardly opening V-shaped members oriented at an acute angle with respect to each other said first V-shaped member being positioned below said second V-shaped member, said first V-shaped member having legs intersecting at an apex at a first angle and aligned with said shaft and said second V-shaped member having legs intersecting at an apex aligned with said shaft and converging at a second angle substantially smaller than said first angle said second V-shaped member lying in a plane generally aligned with said shaft.

10. The apparatus as defined in claim 9 wherein the legs of said second V-shaped member are substantially longer than the legs of said first V-shaped member.

11. The apparatus as defined in claim 10 wherein said acute angle is from about 40° to 60°.

12. The apparatus as defined in claim 11 wherein the angle of intersection of said legs of said first V-shaped member is from about 30° to 50°.

13. The apparatus as defined in claim 12 wherein the angle of intersection of said legs of said second V-shaped member is from about 15° to 30°.

14. The apparatus as defined in claim 13 wherein said shaft is hollow and the legs of said second V-shaped member extend into said shaft for securing said guide to said shaft.

* * * * *